US009960527B2

(12) United States Patent
Dowhower et al.

(10) Patent No.: US 9,960,527 B2
(45) Date of Patent: May 1, 2018

(54) ELECTRICAL ASSEMBLY HAVING A BACKSHELL WITH A CABLE FOLLOWER

(71) Applicant: TYCO ELECTRONICS CORPORATION, Berwyn, PA (US)

(72) Inventors: Kenneth Paul Dowhower, Harrisburg, PA (US); Dustin Carson Belack, Hummelstown, PA (US); Nicholas Paul Ruffini, York, PA (US)

(73) Assignee: TE CONNECTIVITY CORPORATION, Berwyn, PA (US)

( * ) Notice: Subject to any disclaimer, the term of this patent is extended or adjusted under 35 U.S.C. 154(b) by 0 days. days.

(21) Appl. No.: 15/240,064

(22) Filed: Aug. 18, 2016

(65) Prior Publication Data

US 2018/0054022 A1 Feb. 22, 2018

(51) Int. Cl.
*H01R 13/58* (2006.01)
*H01R 13/56* (2006.01)

(52) U.S. Cl.
CPC ..... *H01R 13/5812* (2013.01); *H01R 13/562* (2013.01)

(58) Field of Classification Search
CPC ..... H01R 13/562; H01R 13/5812
See application file for complete search history.

(56) References Cited

U.S. PATENT DOCUMENTS 2,472,986 A * 6/1949 Reder, Jr. ..... H01R 13/562 439/448
3,622,942 A 11/1971 Rynk
3,732,526 A 5/1973 Punako
4,808,123 A 2/1989 Dee et al.
5,030,135 A * 7/1991 Plesinger ..... G02B 6/4478 174/135
5,933,557 A * 8/1999 Ott ..... G02B 6/3887 385/86
6,419,519 B1 * 7/2002 Young ..... H01R 13/5812 439/446
6,422,884 B1 * 7/2002 Babasick ..... H01R 13/5812 439/222
6,478,609 B1 * 11/2002 Davis ..... H01R 13/5812 439/465

(Continued)

OTHER PUBLICATIONS

Glenair; AS85049/45 and MS27663-1 Straight Composite Non-Self-Locking Strain Relief; 2013; 1 page.

(Continued)

*Primary Examiner* — James Harvey

(57) ABSTRACT

An electrical assembly includes a backshell having a coupling nut defining a cavity and a cable follower received in the cavity and extending rearward from the coupling nut. The cable follower has a plurality of rearward extending spring fingers extending to distal ends and being tapered inward to the distal ends to define a generally conical shaped cable channel configured to receive a cable. The spring fingers are deflectable and are spring biased against the cable in different radial directions to provide a clamping force against the cable and to substantially center the cable in the cable channel. The electrical assembly includes a retention feature coupled between the cable follower and the coupling nut allowing the coupling nut to be rotatably coupled to the cable follower such that the coupling nut is rotatable relative to the cable.

19 Claims, 5 Drawing Sheets

(56) References Cited

U.S. PATENT DOCUMENTS

| | | | | |
|---|---|---|---|---|
| 7,635,283 | B1 | 12/2009 | Islam | |
| 9,197,008 | B1 | 11/2015 | Myong | |
| 9,413,116 | B1 * | 8/2016 | Villasenor | H01R 13/5812 |
| 9,627,800 | B2 * | 4/2017 | Taylor | H01R 13/5841 |
| 2004/0121650 | A1 * | 6/2004 | Lazaro, Jr. | H01R 9/032 439/598 |
| 2009/0318033 | A1 | 12/2009 | Tobey | |
| 2012/0100745 | A1 | 4/2012 | Myong et al. | |
| 2014/0148044 | A1 | 5/2014 | Balcer et al. | |
| 2014/0265308 | A1 * | 9/2014 | Reilly | H01R 13/5841 285/153.1 |
| 2015/0104976 | A1 * | 4/2015 | Myong | H01R 13/648 439/607.41 |
| 2016/0365669 | A1 * | 12/2016 | Taylor | H01R 13/5841 |
| 2017/0085026 | A1 * | 3/2017 | Sandwith | H01R 13/5812 |

OTHER PUBLICATIONS

European Search Report, dated Oct. 26, 2017, EP 17 18 5895, Application No. 17185895.4-1801.

* cited by examiner

ELECTRICAL ASSEMBLY HAVING A BACKSHELL WITH A CABLE FOLLOWER

BACKGROUND OF THE INVENTION

The subject matter herein relates generally to electrical assemblies having threaded coupling nuts for securing connectors or connector pieces together.

Some conventional electrical connectors are secured together using a threaded coupling nut. For example, some applications include a male connector connected to a female connector using a threaded coupling nut. Other applications include a backshell or adaptor coupled to a front, mating piece using a threaded coupling nut. The threaded coupling nut is freely rotatable about an end of one connector or connector piece. The threaded coupling nut typically has internal threads that are threadably coupled to external threads of another connector or connector piece. A cable extends from the rear of the connector or connector piece. However the cables may be damaged at the cable exit, such as by being subjected to excessive strain at the cable exit or by over-bending, such as beyond a bend limit for the cable.

To protect the cables, some known connectors provide a cable clamp at the back end of the connector. However, known connectors having cable clamps are not without disadvantages. For example, the cable clamps do not clamp the cables uniformly around the perimeter of the cables. The non-uniform clamping pressure can result in excessive stress on some of the conductors of the cable, causing premature failure of the cable. The non-uniform clamping pressure may distort the cable, which may distort sealing glands in which the conductors are located compromising the sealing effectiveness and allowing for fluid ingress that can cause corrosion, dielectric breakdown or shorting.

A need remains for an electrical assembly that provides sufficient clamping pressure on the cable while avoiding excessive stresses on the conductors of the cable.

BRIEF SUMMARY OF THE INVENTION

In one embodiment, an electrical assembly is provided including a backshell having a coupling nut defining a cavity and a cable follower received in the cavity and extending rearward from the coupling nut. The cable follower has a plurality of rearward extending spring fingers extending to distal ends. The spring fingers define a cable channel configured to receive a cable. The spring fingers are deflectable and are spring biased against the cable to provide a clamping force against the cable. The spring fingers are tapered inward to the distal ends to define a generally conical shaped cable channel. The spring fingers are spring biased against the cable in different radial directions to substantially center the cable in the cable channel. The electrical assembly includes a retention feature coupled between the cable follower and the coupling nut. The retention feature allows the coupling nut to be rotatably coupled to the cable follower such that the coupling nut is rotatable relative to the cable, the coupling nut being configured to be coupled to a front shell of the electrical assembly.

In another embodiment, an electrical assembly is provided including a backshell having a coupling nut defining a cavity, a cavity insert received in the cavity and a cable follower received in the cavity and extending rearward from the coupling nut for supporting a cable. The cavity insert has a braid lip configured to be mechanically and electrically coupled to a cable braid of the cable. The cavity insert has a keying feature configured to engage the cable follower to secure the relative position of the cavity insert with respect to the cable follower. The cable follower has a plurality of rearward extending spring fingers extending to distal ends. The spring fingers define a cable channel configured to receive the cable. The spring fingers are deflectable and spring biased against the cable to provide a clamping force against the cable. The spring fingers are tapered inward to the distal ends to define a generally conical shaped cable channel. The spring fingers are spring biased against the cable in different radial directions to substantially center the cable in the cable channel. The coupling nut is rotatably coupled to the cable follower such that the coupling nut is rotatable relative to the cable. The coupling nut is configured to be coupled to a front shell of the electrical assembly.

In a further embodiment, an electrical assembly is provided including a backshell having a coupling nut defining a cavity and a cable follower received in the cavity and extending rearward from the coupling nut. The cable follower has ratchet slots at a front end of the cable follower. The cable follower has a plurality of rearward extending spring fingers extending to distal ends. The spring fingers define a cable channel configured to receive a cable. The spring fingers are deflectable and are spring biased against the cable to provide a clamping force against the cable. The spring fingers are tapered inward to the distal ends to define a generally conical shaped cable channel. The spring fingers are spring biased against the cable in different radial directions to substantially center the cable in the cable channel. The electrical assembly includes a retention feature coupled between the cable follower and the coupling nut. The retention feature has a ratchet feature operably received in the ratchet slots to rotatably fix the coupling nut to the cable follower at defined ratchet positions. The retention feature allows the coupling nut to be rotatably coupled to the cable follower such that the coupling nut is rotatable relative to the cable, the coupling nut being configured to be coupled to a front shell of the electrical assembly.

DETAILED DESCRIPTION OF SPECIFIC EMBODIMENTS OF THE INVENTION

Figure 1:
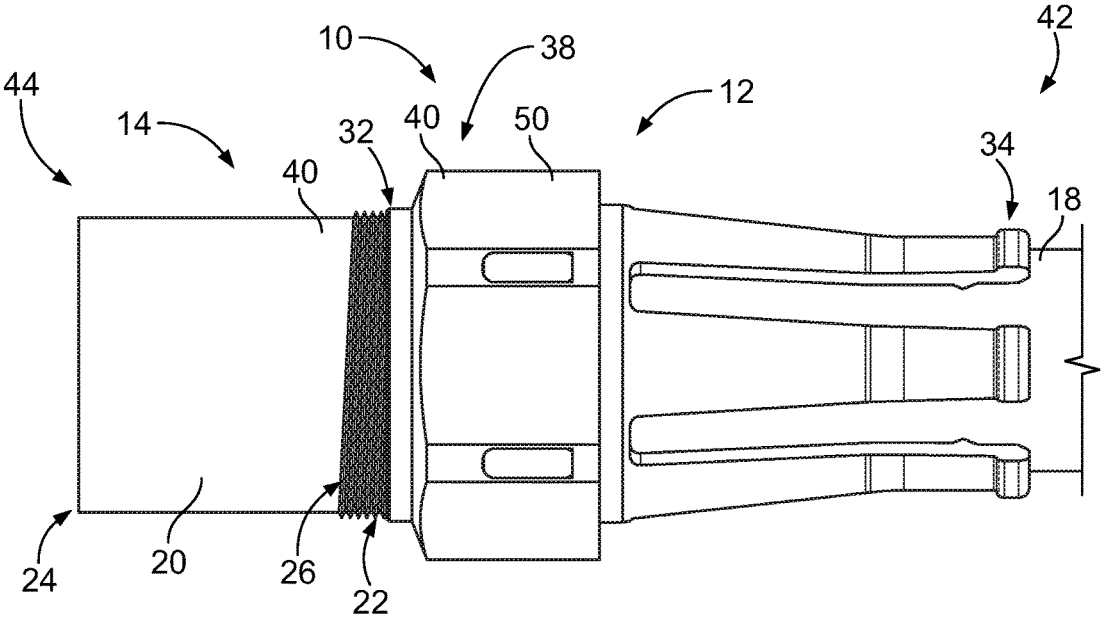
FIG. 1 is an exploded view of an electrical assembly formed in accordance with an exemplary embodiment

FIG. 1 is an exploded view of an electrical assembly 10 formed in accordance with an exemplary embodiment. The electrical assembly 10 includes a first connector portion 12 and a second connector portion 14 that receives the first connector portion 12 when assembled or mated. Optionally, the electrical assembly 10 may be used in a system to transmit data and/or power. The electrical assembly 10 may be suitable for use in the aerospace industry, automotive industry or the like. Optionally, the connector portions 12, 14 may both be separate electrical connectors that are electrically connected together, such as to connect two different cables and/or devices of an electrical system. Alternatively, as in the illustrated embodiment, the first connector portion 12 and the second connector portion 14 may be separate pieces of a common connector that are joined or coupled together to define a single electrical connector assembly that is then configured to be mated or plugged to another electrical connector. For example, the connector portion 12 may define a rear end portion and the connector portion 14 may define a front end portion of the electrical assembly 10.

In an exemplary embodiment, the connector portion 12 defines a backshell and may be referred to hereinafter as a backshell 12. The backshell 12 is a connector accessory or an adapter that directs wires or conductors of a cable 18 into the front end connector. In such embodiments, the backshell 12 may provide strain relief for the conductors and the cable 18. The backshell 12 may be electrically grounded to the cable 18, such as a cable braid or cable shield, and may be electrically grounded to the front end connector 14, such as a housing of the front end connector 14. In such embodiments, the connector portion 14 defines a front shell and may be referred to hereinafter as a front shell 14. The front shell 14 holds contacts, terminals or a circuit board defining a mating interface configured to be mated to another connector assembly.

The second connector portion 14 includes a connector body or housing 20 with a first end 22 and a second end 24 opposite the first end 22. The connector portion 12 is configured to be coupled to the first end 22. In an exemplary embodiment, the second connector portion 14 has a threaded area 26 at the first end 22. The connector portion 12 is threadably coupled to the threaded area 26, such as by a threaded coupling nut. In the illustrated embodiment, the connector portion 12 and the second connector portion 14 are connector pieces joined together to define a single electrical connector configured to be mated with another electrical connector at the second end 24. The conductors extend from the first end 22 as a cable bundle and pass through the connector portion 12. Alternatively, the connector portions 12, 14 may be separate connectors mated together and the cable may extend from the second end 24 of the second connector portion 14 with a separate cable extending from the connector portion 12.

The first connector portion 12 extends between a mating end 32 at a front and a cable end 34 at a rear opposite the mating end 32. The mating end 32 of the first connector portion 12 includes a threaded coupling nut 50 that is threadably coupled to the threaded area 26 at the first end 22 of the second connector portion 14.

In the illustrated embodiment, the connector portions 12, 14 are connector pieces joined together to define a single electrical connector 38 having a housing 40. The housing 40 is defined by the connector portions 12, 14. For example, the backshell 12 is coupled to the front shell 14 to define the housing 40 of the electrical connector 38. The cable 18 passes through the backshell 12 into the front shell 14 where the conductors are terminated to corresponding contacts or terminals (not shown) or to a circuit board. The backshell 12 secures the cable 18 to the front shell 14 and protects the conductors from forces that may be imposed on the cable 18 and/or the electrical assembly 10. The cable end 34 defines a cable end 42 of the housing 40. The second end 24 of the front shell 14 defines a mating end 44 of the housing 40. Optionally, the mating end 44 may be threaded. The mating end 44 may define a plug or a receptacle for mating with another electrical connector assembly. The backshell 12 prevents the cable 18 from being damaged from external elements. The backshell 12 may also provide electromagnetic shielding for the conductors. For example, the backshell 12 may be electrically terminated to a cable braid or cable shield of the cable 18.

Figure 2:
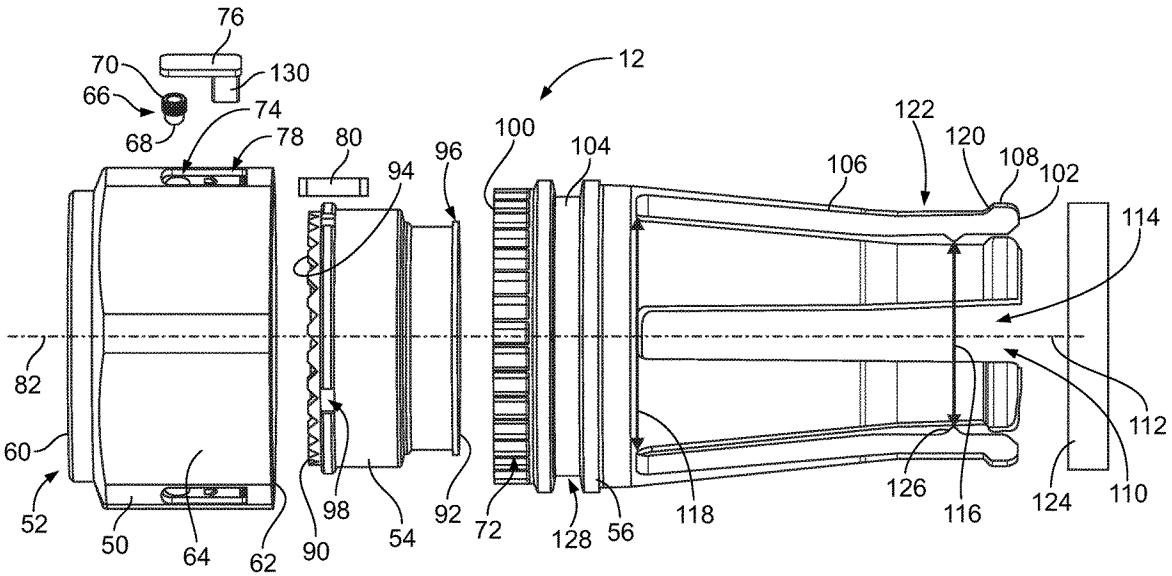
FIG. 2 is an exploded view of a backshell of the electrical assembly in accordance with an exemplary embodiment.

FIG. 2 is an exploded view of the backshell 12 in accordance with an exemplary embodiment. The backshell 12 has a coupling nut 50 defining a cavity 52, a cavity insert 54 received in the cavity 52 and a cable follower 56 received in the cavity 52. The cable follower 56 extends rearward from the coupling nut 50 for supporting the cable 18. The cable follower 56 is used to support the cable 18 to prevent excessive strain at the cable exit from over-bending beyond a bend limit for the cable 18. The cavity insert 54 may also be used to support the cable 18, such as an interior portion of the cable 18, a cable braid of the cable 18, and the like. The cavity insert 54 may be electrically connected to the cable 18, such as the cable braid, to provide electrical shielding or grounding. The cavity insert 54 may engage the second connector portion 14 (shown in FIG. 1) to support the cable 18, such as by providing an anti-rotation feature for the first connector portion 12 relative to the second connector portion 14. The coupling nut 50 is configured to be rotatably coupled to the cable follower 56 and/or the cavity insert 54. The coupling nut 50 is configured to be threadably coupled to the second connector portion 14.

The coupling nut 50 extends between a front 60 and a rear 62. The cavity 52 extends along a cavity axis 82 between the front 60 and the rear 62. The cable 18 may pass into and/or through the cavity 52 along the cavity axis 82. The cavity axis 82 may be parallel to a mating direction of the backshell 12 with the front shell 14.

The coupling nut 50 includes a plurality of flat surfaces 64 around the perimeter of the coupling nut 50 that may be engaged by a tool used to rotate the coupling nut 50 for tightening or untightening the coupling nut 50 from the second connector portion 14. In an exemplary embodiment, the coupling nut 50 is a hexagonal shaped nut having six flat surfaces 64. Optionally, the interior of the coupling nut 50 may be generally cylindrical shaped and may be threaded.

In an exemplary embodiment, the backshell 12 includes a ratchet feature 66 used to rotatably fix the coupling nut 50 to the cable follower 56 at defined ratchet positions. For example, the ratchet feature 66 may include a ball bearing 68 and a spring 70 engaging the ball bearing 68. The ball bearing 68 may be received in ratchet slots 72 on the cable follower 56, which may be at or near the front end of the cable follower 56. The ratchet feature 66 is received in an opening 74 in the coupling nut 50. The ratchet feature 66 may be part of a retention feature 76 used to retain the coupling nut 50 to the cable follower 56.

In an exemplary embodiment, the retention feature 76 is used to secure the ratchet feature 66 in the opening 74. The coupling nut 50 includes a pocket 78 that receives the retention feature 76. Optionally, the retention feature 76 may be retained in the pocket 78 using a pin 80 configured to be received in the coupling nut 50, such as into the rear 62 of the coupling nut 50. The retention feature 76 may be rotatable with the coupling nut 50 relative to the cable follower 56. In an exemplary embodiment, the retention feature 76 is used to retain the coupling nut 50 on the cable follower 56. For example, the retention feature 76 may hold an axial position of the coupling nut 50 on the cable follower 56. In an exemplary embodiment, the retention feature 76 may be rotatably coupled to the cable follower 56 to allow the coupling nut 50 to rotate relative to the cable follower 56, as described in further detail below.

The cavity insert 54 extends between a front 90 and a rear 92. The cavity insert 54 is configured to be received in the cable follower 56. In an exemplary embodiment, the cavity insert 54 includes a plurality of anti-rotation teeth 94 at the front 90 configured to resist rotation of the cavity insert 54 and the cable follower 56 relative to the front shell 14. For example, the anti-rotation teeth 94 may mesh with or dig into a portion of the front shell 14 to resist rotation thereof.

In an exemplary embodiment, the cavity insert 54 includes a braid lip 96 at the rear 92. The braid lip 96 is configured to be mechanically and electrically coupled to a cable braid of the cable 18 (shown in FIG. 1). For example, the cable braid may be dressed over the exterior perimeter of the cavity insert 54 at the braid lip 96. A band or retaining ring may be received around the exterior of the cable braid to retain the cable braid to the braid lip 96. The braid lip 96 may define a shoulder used to hold the band in place on the cavity insert 54.

In an exemplary embodiment, the cavity insert 54 includes one or more keying features 98 configured to engage the cable follower 56 to secure the relative position of the cavity insert 54 with respect to the cable follower 56. For example, the keying feature 98 may engage the cable follower 56 to resist rotation of the cavity insert 54 relative to the cable follower 56.

The cable follower 56 extends between a front 100 and a rear 102. The cable follower 56 has a base ring 104 at the front 100 and a plurality of spring fingers 106 extending rearward from the base ring 104 to distal ends 108 at the rear 102. The spring fingers 106 surround and define a cable channel 110 configured to receive the cable 18. The cable channel 110 extends along a cable channel axis 112. Optionally, as in the illustrated embodiment, the cable channel axis 112 may be generally parallel to the cavity axis 82. Alternatively, the cable channel axis 112 may be angled non-parallel to the cavity axis 82. For example, the spring fingers 106 may be angled away from the base ring 104, such as at an approximate 45° angle, an approximate 90° angle or at another angle to dress the cable 18 at such angle relative to the mating end 32 of the backshell 12.

The spring fingers 106 are deflectable and configured to be spring biased against the cable 18 to provide a clamping force against the cable 18. In an exemplary embodiment, the spring fingers 106 are cantilevered such that the distal ends 108 are free from each other. The spring fingers 106 are circumferentially disposed around the cable channel 110. In an exemplary embodiment, the spring fingers 106 are circumferentially disposed entirely around the cable channel 110. Alternatively, the spring fingers 106 may be circumferentially disposed a majority of the way around the cable channel 110 with a receiving opening along one side for side-loading the cable 18 into the cable channel 110 rather than end-loading the cable 18 through the rear 102 of the cable follower 56. The spring fingers 106 provide a uniform clamping force around the cable 18 providing uniform radial clamping pressure on the cable 18. The spring fingers 106 are circumferentially spaced apart by gaps 114 to allow independent movement of the spring fingers 106 relative to each other.

In an exemplary embodiment, the spring fingers 106 are tapered inward to the distal ends 108 to define a generally conical-shaped cable channel 110. For example, the cable channel 110 may have a first diameter 116 at the base ring 104 and the cable channel 110 may have a second diameter 118 less than the first diameter 116 at the distal ends 108. By tapering inward, the spring fingers 106 may be configured to engage the cable 18 at or near the distal ends 108 such that the spring fingers 106 may be spring biased against the cable 18. The spring fingers 106 are spring biased against the cable 18 to provide a clamping force against the cable 18. In an exemplary embodiment, the spring fingers 106 are spring biased against the cable in different radial directions to substantially center the cable 18 in the cable channel 110. For example, by having the spring fingers 106 circumferentially disposed entirely or substantially entirely around the cable channel 110, the cable 18 may be biased in substantially all radial directions to substantially center the cable 18 in the cable channel 110. In the illustrated embodiment, the cable follower 56 includes six spring fingers 106 spaced equidistant apart from each other about the circumference of the cable channel 110, such as at 60° intervals about the circumference of the cable channel 110. Each spring finger 106 has a countering spring finger on the opposite side of the cable channel 110 located 180° apart to provide clamping forces in generally opposite directions. Such opposite clamping forces tend to center the cable 18 within the cable channel 110.

In an exemplary embodiment, the spring fingers 106 include ribs 120 provided at the distal ends 108. The ribs 120 are provided along the exterior surfaces of the spring fingers 106. The spring fingers 106 each include a clamp end 122 at or near the distal ends 108 that are configured to engage the cable 18. The ribs 120 may be provided at or rearward of the clamp end 122. In an exemplary embodiment, a band strap 124 may wrap around the spring fingers 106 at the clamp end 122. The band strap 124 may be tightened to compress the spring fingers 106 inward around the cable 18. The ribs 120 may provide a positive retention for the band strap 124 to insure that the band strap 124 does not slip off the distal ends 108 of the spring fingers 106. In an exemplary embodiment, the spring fingers 106 at the clamp end 122 may be generally flat rather than tapered. For example, the tapered portions of the spring fingers 106 may be forward of the clamp end 122. In an exemplary embodiment, the spring fingers 106 include tabs 126 extending inward from the spring fingers 106 at the clamp end 122. The tabs 126 may engage the cable 18. For example, the tabs 126 may dig into the jacket of the cable 18 to provide resistance against shifting or pull-out of the cable 18 from the cable channel 110. The tabs 126 may be triangular-shaped and include an edge that digs into the cable 18. Other types of securing features may be provided in alternative embodiments.

The cable follower 56 includes the ratchet slots 72 at the front 100. The ratchet slots 72 are provided circumferentially around the exterior of the base ring 104. In an exemplary embodiment, the cable follower 56 includes a retention groove 128 extending circumferentially around the base ring 104. The retention groove 128 receives a lug 130 of the retention feature 76. The lug 130 is configured to rotate about the base ring 104 within the retention groove 128. However, the retention groove 128 fixes the axial position of the retention feature 76 relative to the cable follower 56, which fixes the axial position of the coupling nut 50 relative to the cable follower 56.

Figure 3:
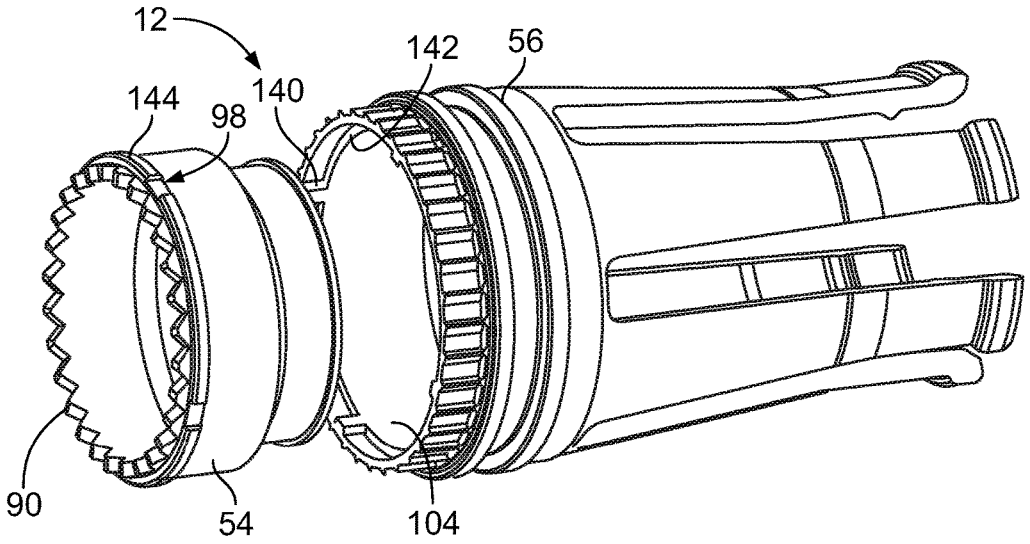
FIG. 3 is a perspective view of a portion of the backshell showing a cavity insert poised for loading into a cable follower.
Figure 4:
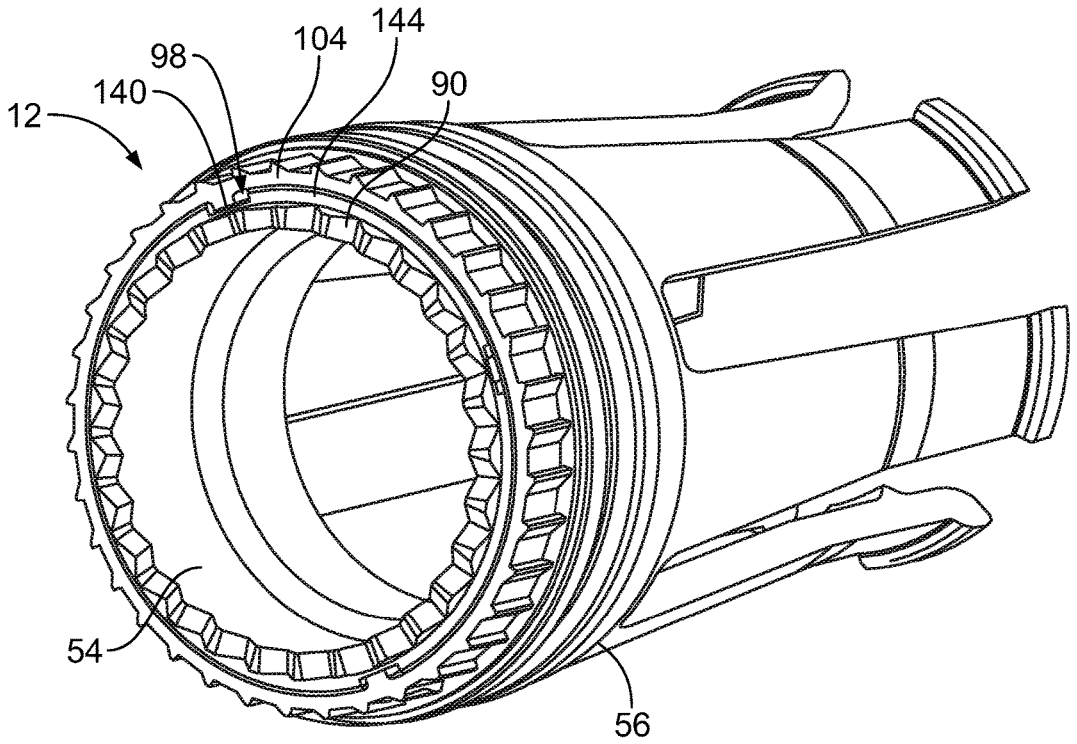
FIG. 4 is a perspective view of a portion of the backshell showing the cavity inserts loaded into the cable follower.

FIG. 3 is a perspective view of a portion of the backshell 12 showing the cavity insert 54 poised for loading into the cable follower 56. FIG. 4 is a perspective view of a portion of the backshell 12 showing the cavity inserts 54 loaded into the cable follower 56. The cable follower 56 includes key tabs 140 in the interior of the base ring 104. The key tabs 140 are configured to interface with the corresponding keying features 98 of the cavity insert 54. In the illustrated embodiment, the keying feature 98 are slots or grooves formed in the cavity insert 54 that receive the key tabs 140 to align the cavity insert 54 with the cable follower 56. In an exemplary embodiment, the cable follower 56 includes a follower shoulder 142 in the cavity of the base ring 104. The cavity insert 54 is received in the base ring 104 until a rim 144 at the front 90 of the cavity insert 54 engages and bottoms out against the follower shoulder 142. The follower shoulder 142 blocks rearward movement of the cavity insert 54 relative to the cable follower 56.

Figure 5:
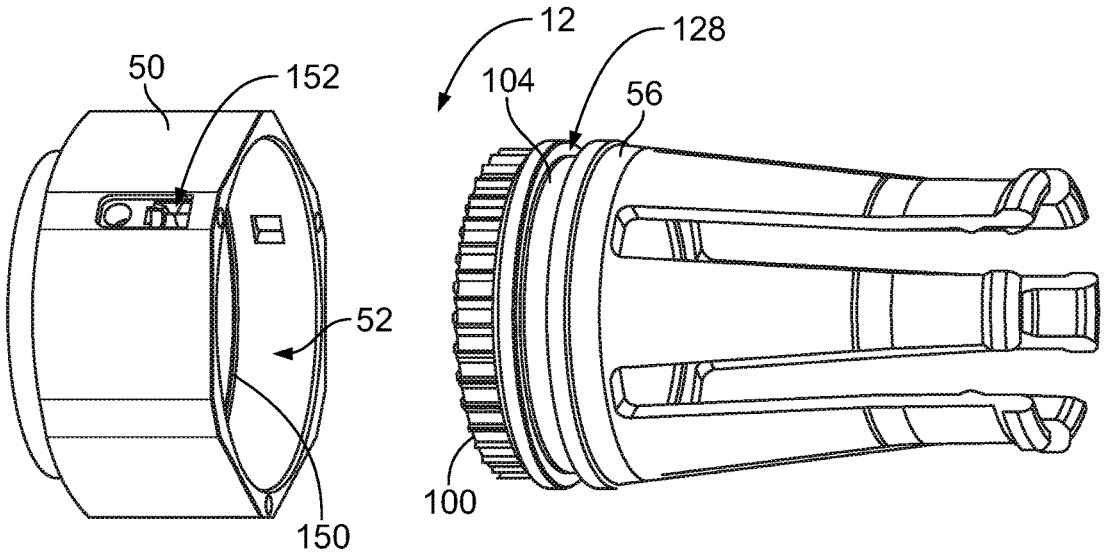
FIG. 5 is a perspective view of the backshell showing a coupling nut poised for coupling to the cable follower.

FIG. 5 is a perspective view of the backshell 12 showing the coupling nut 50 poised for coupling to the cable follower 56. The coupling nut 50 may be loaded over the front 100 of the cable follower 56. In an exemplary embodiment, the coupling nut 50 includes a coupling nut shoulder 150 in the cavity 52. The coupling nut 50 may be loaded onto the front 100 of the cable follower 56 until the front 100 of the cable follower 56 bottoms out against the coupling nut shoulder 150. When fully mated, an opening 152 in the coupling nut 50 may be aligned with the retention groove 128 around the base ring 104.

Figure 6:
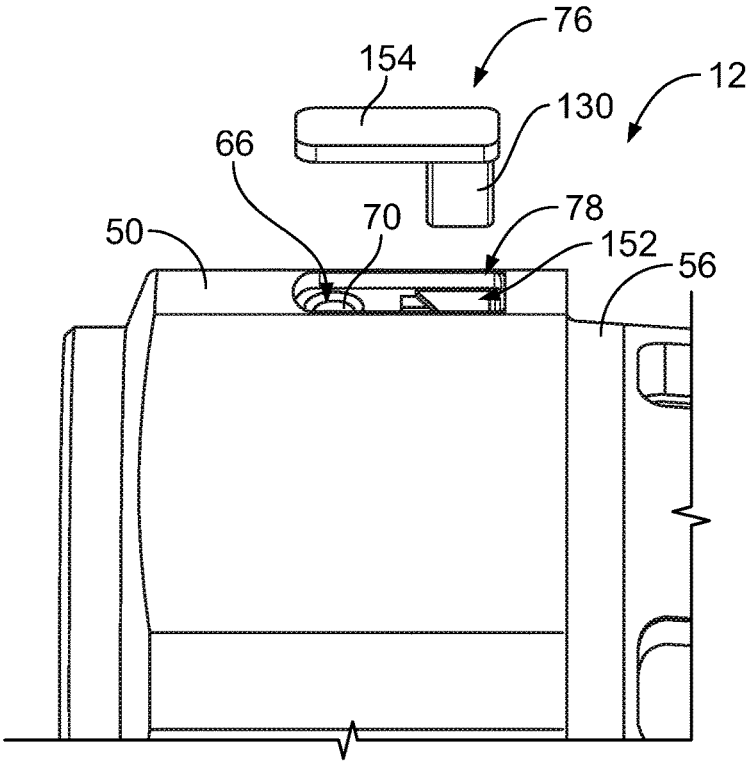
FIG. 6 is a partially assembled view of the backshell showing a retention feature poised for loading into the coupling nut.

FIG. 6 is a partially assembled view of the backshell 12 showing the retention feature 76 poised for loading into the coupling nut 50. After the ratchet feature 66 is loaded into the coupling nut 50, the retention feature 76 may be loaded into the pocket 78. The lug 130 may pass through the opening 152 into the retention groove 128 (shown in FIG. 5) of the cable follower 56 to secure the coupling nut 50 to the cable follower 56. When the retention feature 76 is coupled to the coupling nut 50, a plate 154 of the retention feature 76 engages the ratchet feature 66, such as the spring 70 of the ratchet feature 66, to hold the ratchet feature 66 in the coupling nut 50.

Figure 7:
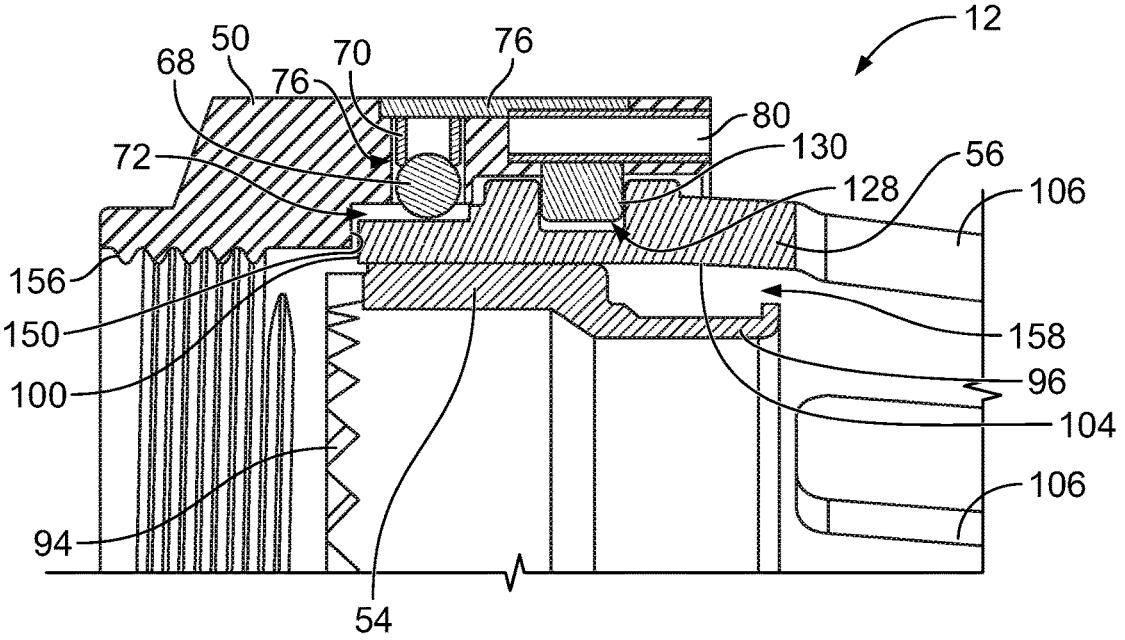
FIG. 7 is a cross-sectional view of a portion of the backshell in an assembled state.

FIG. 7 is a cross-sectional view of a portion of the backshell 12 in an assembled state. FIG. 7 illustrates the retention feature 76 coupled to the coupling nut 50. The lug 130 of the retention feature 76 is received in the retention groove 128. The pin 80 holds the retention feature 76 in the coupling nut 50. The retention feature 76 holds the ratchet feature 66 in the coupling nut 50. For example, the plate 154 blocks the spring 70, which biases the ball bearing 68 into the ratchet slot 72 of the cable follower 56.

In the assembled state, the front 100 of the cable follower 56 is loaded against the coupling nut shoulder 150. The coupling nut 50 is freely rotatable relative to the cavity insert 54 and the cable follower 56. As such, threads 156 of the coupling nut 50 at the front 60 may be threadably coupled to the second connector portion 14. As the coupling nut 50 is threadably coupled to the second connector portion 14, the anti-rotation teeth 94 of the cavity insert 54 may engage the second connector portion 14 to stop or resist rotation of the cavity insert 54 and the cable follower 56 relative to the second connector portion 14.

In an exemplary embodiment, a space 158 is provided between the braid lip 96 and the interior of the base ring 104. The cable braid and/or the cable jacket of the cable 18 may be received in the space 158. A braid strap may be received in the space 158 to mechanically and electrically connect the cable braid to the braid lip 96 of the cavity insert 54. The spring fingers 106 extend rearward of the base ring 104. In an exemplary embodiment, the spring fingers 106 are tapered inward from the base ring 104.

Figure 8:
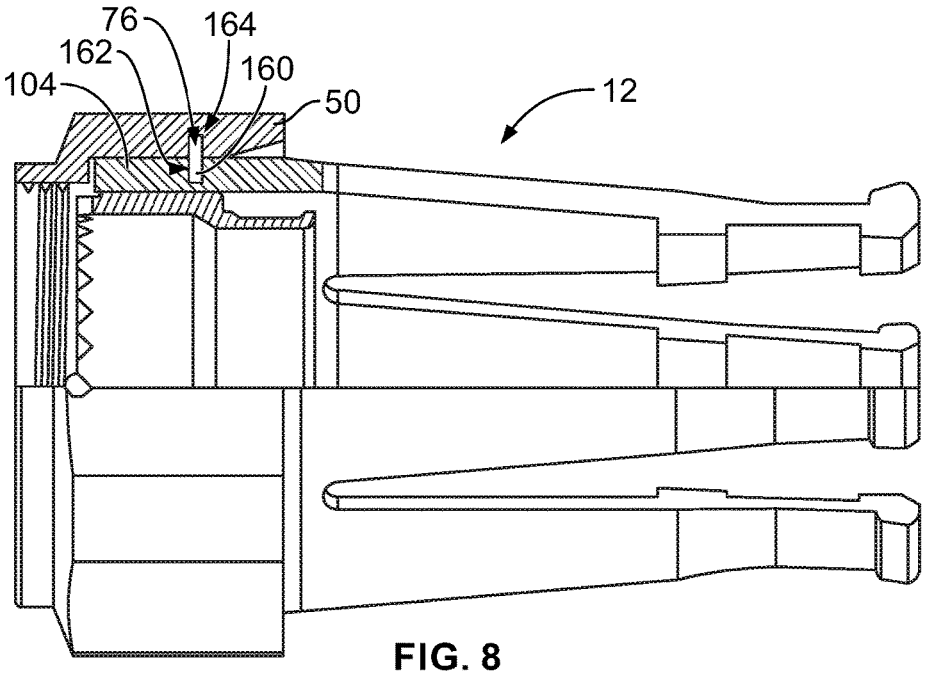
FIG. 8 is a cross-sectional view of the backshell in accordance with an exemplary embodiment.

FIG. 8 is a cross-sectional view of the backshell 12 in accordance with an exemplary embodiment. In the illustrated embodiment, the retention feature 76 is illustrated as a captive ring 160 rather than the plug shown in FIG. 7. The captive ring 160 may extend at least partially circumferentially around the base ring 104 and may be captured in corresponding grooves 162, 164 in the base ring 104 and the coupling nut 50.

Figure 9:
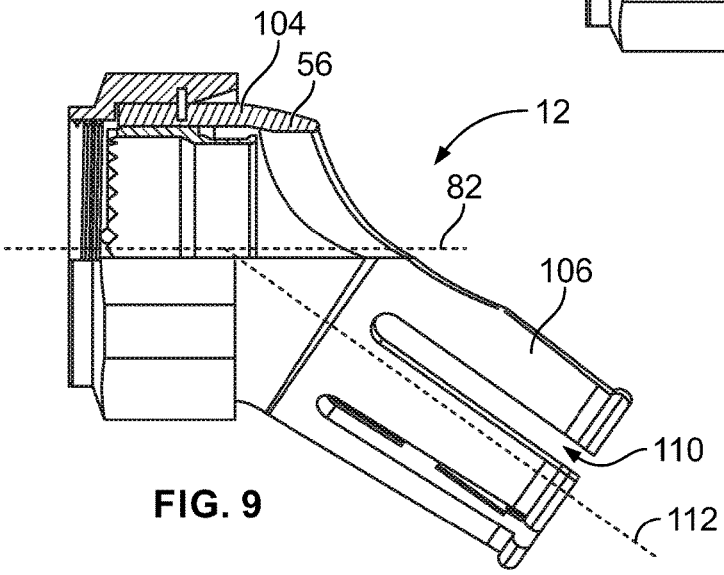
FIG. 9 is a cross-sectional view of the backshell in accordance with an exemplary embodiment.

FIG. 9 is a cross-sectional view of the backshell 12 in accordance with an exemplary embodiment. In the illustrated embodiment, the cable follower 56 has the spring fingers 106 extending at an angle, such as approximately a 45° angle. The cable channel axis 112 extends at an angle with respect to the cavity axis 82. The cable 18 may be loaded into the cable follower 56 through the rear of the base ring 104 and press downward into the spring fingers 106 through an opening in the top of the spring fingers 106. The spring fingers 106 are circumferentially disposed about a majority of the cable channel 110 to retain the cable 18 in the cable channel 110. For example, the spring fingers 106 may be disposed at approximately 45°, 100°, 160°, 210°, 260° and 315° from vertical. The slightly larger gap (for example, end spring fingers disposed approximately 90° apart) between the top two spring fingers 106 provide a space to receive the cable 18 into the cable channel 110. The spring fingers 106 provide a generally uniform clamping force around the cable 18 to center the cable 18 in the cable channel 110. A band strap or zip tie may be used to wrap around the cable 18 and the spring fingers 106 to retain the cable 18 in the cable channel 110.

Figure 10:
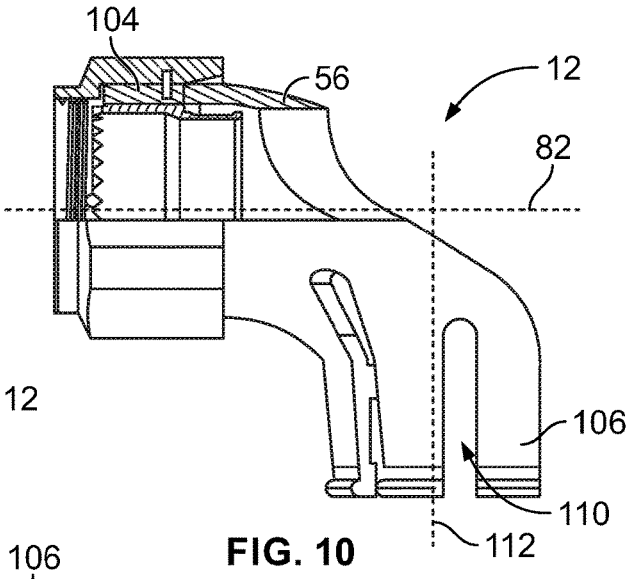
FIG. 10 is a partial-sectional view of the backshell in accordance with an exemplary embodiment.

FIG. 10 is a partial-sectional view of the backshell 12 in accordance with an exemplary embodiment. In the illustrated embodiment, the cable follower 56 has the spring fingers 106 extending at an angle, such as approximately a 90° angle. The cable channel axis 112 extends at an angle with respect to the cavity axis 82. The cable 18 may be loaded into the cable follower 56 through the rear of the base ring 104 and press downward into the spring fingers 106 through an opening along the rear of the spring fingers 106. The spring fingers 106 are circumferentially disposed about a majority of the cable channel 110 to retain the cable 18 in the cable channel 110. The spring fingers 106 provide a generally uniform clamping force around the cable 18 to center the cable 18 in the cable channel 110. A band strap or zip tie may be used to wrap around the cable 18 and the spring fingers 106 to retain the cable 18 in the cable channel 110.

It is to be understood that the above description is intended to be illustrative, and not restrictive. For example, the above-described embodiments (and/or aspects thereof) may be used in combination with each other. In addition, many modifications may be made to adapt a particular situation or material to the teachings of the invention without departing from its scope. Dimensions, types of materials, orientations of the various components, and the number and positions of the various components described herein are intended to define parameters of certain embodiments, and are by no means limiting and are merely exemplary embodiments. Many other embodiments and modifications within the spirit and scope of the claims will be apparent to those of skill in the art upon reviewing the above description. The scope of the invention should, therefore, be determined with reference to the appended claims, along with the full scope of equivalents to which such claims are entitled. In the appended claims, the terms "including" and "in which" are used as the plain-English equivalents of the respective terms "comprising" and "wherein." Moreover, in the following claims, the terms "first," "second," and "third," etc. are used merely as labels, and are not intended to impose numerical requirements on their objects. Further, the limitations of the following claims are not written in means—plus-function format and are not intended to be interpreted based on 35 U.S.C. § 112, sixth paragraph, unless and until such claim limitations expressly use the phrase "means for" followed by a statement of function void of further structure.

What is claimed is:

1. An electrical assembly comprising:

a backshell having a coupling nut defining a cavity and a cable follower received in the cavity and extending rearward from the coupling nut, the coupling nut having a pocket, the cable follower having a plurality of rearward extending spring fingers extending to distal ends, the spring fingers defining a cable channel configured to receive a cable, the spring fingers being deflectable and being spring biased against the cable to provide a clamping force against the cable, the spring fingers being tapered inward to the distal ends to define a generally conical shaped cable channel, the spring fingers being spring biased against the cable in different radial directions to substantially center the cable in the cable channel; and a retention feature coupled between the cable follower and the coupling nut, the retention feature allowing the coupling nut to be rotatably coupled to the cable follower such that the coupling nut is rotatable relative to the cable, the coupling nut being configured to be coupled to a front shell of the electrical assembly, wherein the retention feature is held in the pocket in the coupling nut and rotatable with the coupling nut about the cable follower.

2. The electrical assembly of claim 1, wherein the spring fingers are circumferentially disposed around the cable channel and diametrically opposed to each other to provide clamping forces on opposite sides of the cable.

3. An electrical assembly comprising:

a backshell having a coupling nut defining a cavity and a cable follower received in the cavity and extending rearward from the coupling nut, the cable follower having ratchet slots at a front end of the cable follower, the cable follower having a plurality of rearward extending spring fingers extending to distal ends, the spring fingers defining a cable channel configured to receive a cable, the spring fingers being deflectable and being spring biased against the cable to provide a clamping force against the cable, the spring fingers being tapered inward to the distal ends to define a generally conical shaped cable channel, the spring fingers being spring biased against the cable in different radial directions to substantially center the cable in the cable channel; and a retention feature coupled between the cable follower and the coupling nut, the retention feature having a ratchet feature operably received in the ratchet slots to rotatably fix the coupling nut to the cable follower at defined ratchet positions, the retention feature allowing the coupling nut to be rotatably coupled to the cable follower such that the coupling nut is rotatable relative to the cable, the coupling nut being configured to be coupled to a front shell of the electrical assembly.

4. An electrical assembly comprising:

a backshell having a coupling nut defining a cavity and a cable follower received in the cavity and extending rearward from the coupling nut, the coupling nut having a groove, the cable follower having a groove, the cable follower having a plurality of rearward extending spring fingers extending to distal ends, the spring fingers defining a cable channel configured to receive a cable, the spring fingers being deflectable and being spring biased against the cable to provide a clamping force against the cable, the spring fingers being tapered inward to the distal ends to define a generally conical shaped cable channel, the spring fingers being spring biased against the cable in different radial directions to substantially center the cable in the cable channel; and a retention feature coupled between the cable follower and the coupling nut, the retention feature allowing the coupling nut to be rotatably coupled to the cable follower such that the coupling nut is rotatable relative to the cable, the coupling nut being configured to be coupled to a front shell of the electrical assembly, wherein the retention feature is a captive ring discrete from the cable follower and from the coupling nut, the captive ring being received in the groove in the cable follower and received in the groove in the coupling nut.

5. The electrical assembly of claim 1, wherein the cable channel extends linearly through the back shell.

6. The electrical assembly of claim 1, wherein the cavity extends along a cavity axis, the cable channel extending along a cable channel axis, the cable channel axis being angled nonparallel to the cavity axis.

7. The electrical assembly of claim 1, wherein the spring fingers are cantilevered to the distal ends and circumferentially spaced apart by gaps to allow independent movement of the spring fingers relative to each other.

8. The electrical assembly of claim 1, wherein the cable follower has a base ring, the spring fingers extending rearward from the base ring, the cable channel at the base ring having a first diameter, the cable channel at the distal ends having a second diameter less than the first diameter.

9. The electrical assembly of claim 1, wherein the spring fingers are uniformly spaced circumferentially around the cable channel to provide a uniform clamping force around the cable.

10. The electrical assembly of claim 1, wherein the spring fingers include a clamp end at or near the distal ends of the spring fingers configured to engage the cable, the spring fingers having ribs at the clamp end extending laterally across the spring fingers to provide positive retention of a band strap around the spring fingers.

11. The electrical assembly of claim 1, wherein the spring fingers include a clamp end at or near the distal ends of the spring fingers configured to engage the cable, the spring fingers having tabs extending inward from interior surfaces of the spring fingers at the clamp end, the tabs extending laterally across the spring fingers to dig into the cable.

12. The electrical assembly of claim 1, wherein the retention feature comprising a ratchet feature to rotatably fixed the coupling nut to the cable follower at defined ratchet positions.

13. The electrical assembly of claim 1, further comprising a cavity insert received in the cavity, the cavity insert having a braid lip configured to be mechanically and electrically coupled to a cable braid of the cable, the cavity insert having a keying feature configured to engage the cable follower to secure the relative position of the cavity insert with respect to the cable follower.

14. The electrical assembly of claim 13, wherein the cavity insert includes anti-rotation teeth to resist rotation of the cavity insert and the cable follower relative to the front shell.

15. An electrical assembly comprising:

a backshell having a coupling nut defining a cavity, a cavity insert received in the cavity and a cable follower received in the cavity and extending rearward from the coupling nut for supporting a cable;

the cavity insert having a braid lip configured to be mechanically and electrically coupled to a cable braid of the cable, the cavity insert having a keying feature configured to engage the cable follower to secure the relative position of the cavity insert with respect to the cable follower;

the cable follower having a plurality of rearward extending spring fingers extending to distal ends, the spring fingers defining a cable channel configured to receive the cable, the spring fingers being deflectable and being spring biased against the cable to provide a clamping force against the cable, the spring fingers being tapered inward to the distal ends to define a generally conical shaped cable channel, the spring fingers being spring biased against the cable in different radial directions to substantially center the cable in the cable channel;

the coupling nut being rotatably coupled to the cable follower such that the coupling nut is rotatable relative to the cable, the coupling nut being configured to be coupled to a front shell of the electrical assembly.

16. The electrical assembly of claim 15, further comprising a retention feature coupled between the cable follower and the coupling nut, the retention feature allowing the coupling nut to be rotatably coupled to the cable follower such that the coupling nut is rotatable relative to the cable, the coupling nut being configured to be coupled to a front shell of the electrical assembly.

17. The electrical assembly of claim 16, wherein the retention feature comprises a ratchet feature to rotatably fixed the coupling nut to the cable follower at defined ratchet positions.

18. The electrical assembly of claim 15, wherein the cavity insert includes anti-rotation teeth to resist rotation of the cavity insert and the cable follower relative to the front shell.

19. The electrical assembly of claim 3, wherein the spring fingers are cantilevered to the distal ends and circumferentially spaced apart by gaps to allow independent movement of the spring fingers relative to each other.

* * * * *